United States Patent [19]

Nielsen

[11] 4,224,930

[45] Sep. 30, 1980

[54] METHOD OF AND APPARATUS FOR THE PERFORMING OF A THERAPEUTIC EFFECT

[76] Inventor: Hugo Nielsen, Kirkealle 14, DK-6510, Gram, Denmark

[21] Appl. No.: 798,254

[22] Filed: May 18, 1977

[30] Foreign Application Priority Data

May 25, 1976 [DK] Denmark ..... 2292/76

[51] Int. Cl.[2] ..... A61H 1/02

[52] U.S. Cl. ..... 128/25 B

[58] Field of Search ..... 128/25 R, 25 B, 60, 128/67, 68, 303 R

[56] References Cited

U.S. PATENT DOCUMENTS

| | | | |
|---|---|---|---|
| 1,252,260 | 1/1918 | Gilberg | 128/327 |
| 1,473,041 | 11/1923 | Henderson | 128/327 |
| 2,895,470 | 7/1959 | Reiter | 128/25 B |
| 3,028,857 | 4/1962 | Parker | 128/25 B |

*Primary Examiner*—Lawrence W. Trapp

*Attorney, Agent, or Firm*—Mason, Fenwick & Lawrence

[57] ABSTRACT

An elongated block-like stool has first and second downwardly extending slots which respectively receive the ankle portion of the lower leg and foot of a prone person with each slot having a plurality of openings in which a protruding peg can be removably mounted. Such a peg is positioned in accordance with the size of the foot of the user to engage a nerve ending in the ankle area of each foot of the user to apply pressure to the nerve ending and create a generally beneficial effect on the user. In another embodiment, a protrusion is provided on the inner surface of a strap positionable over the ankle portion of the user with the protrusion being similarly engaged with a nerve ending to effect the beneficial results on the user.

7 Claims, 5 Drawing Figures

METHOD OF AND APPARATUS FOR THE PERFORMING OF A THERAPEUTIC EFFECT

Figure 1:
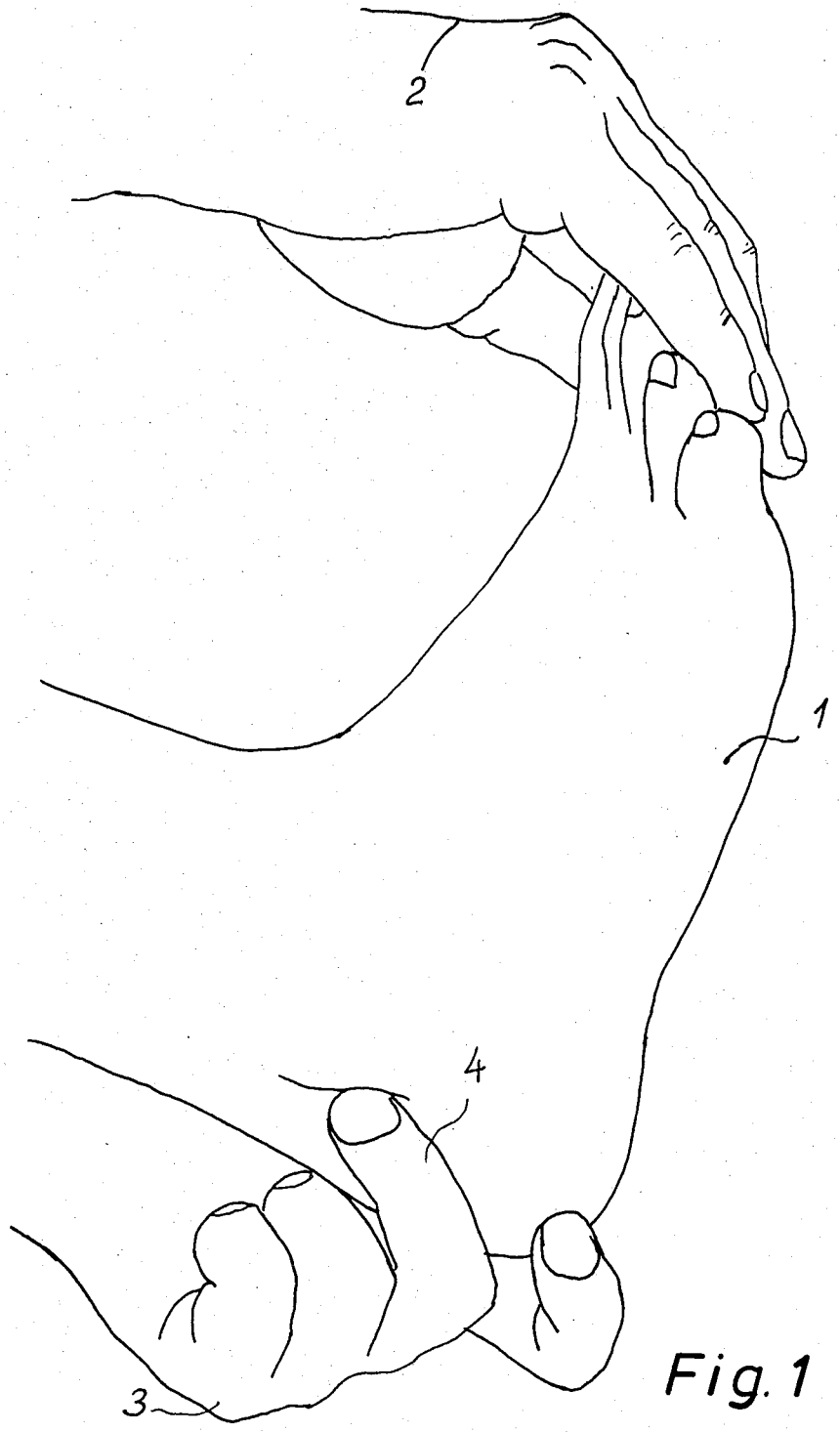

The invention relates to a method of production of a therapeutic effect in the human body.

It is well-known to stimulate or to anaesthetize parts of the human body by a mechanical stress on certain nerves, either by exerting e.g. a pressure or by inserting needles by way of the so-called acupuncture. In these known methods the effect has been limited in the way, that stressing of certain points or nerve centres has caused an effect in certain parts of the body, mainly as long as the stressing has taken place.

The present invention is due to the discovery, that the simultaneous exertion of a pressure on two definite points causes a prolonged effect, consisting in a general improvement of the general condition of the person, who is subjected to the stress.

The method is characteristic in that a pressure is applied simultaneously to the outsides of the right respectively the left foot at a point lying below the Achilles' tendon at the place where same is in connection with the heel, i.e. at the so-called vesicular point no. 60. It has hereby surprisingly proved, that when a person lying in a horizontal position is exposed to such a strain, the person will already after a few minutes feel strongly relaxed and in many cases fall asleep. By treatment of several hundred persons who were, however, also exposed to other like treatment, it has besides proved, that a remarkable improvement of the general condition occurred.

According to the invention mainly equal pressures are applied to the right and the left foot, which seems to be important for achieving good results.

The invention also relates to an apparatus for the performance of the method, and this apparatus is characteristic in means for the pressing in of a protruding peg in the right respectively the left foot simultaneously. By means of such an apparatus a person will be able to subject himself to a treatment, i.e. without any help from another person.

A suitable embodiment of the apparatus is characteristic in a foot stool or trestle with two recesses for the back of the lower end of a pair of legs and to which there is in each recess attached a protruding peg. By such an apparatus a person lying in a horizontal position can in a comfortable way get applied the said pressures. It is thus suitable, that the person subjected to the treatment is lying in a horizontal position, because the first effect which occurs is a strongly relaxed condition.

The apparatus can besides be characteristic in that there is in each recess a number of evenly distributed blind holes, which are arranged for securing a peg and in that each peg is cylindrical at foot with a diameter corresponding to that of the blind holes. It is hereby possible to place two pegs in different positions and so to make an adjustment to a definite person.

Another embodiment is characteristic in two tightening ribbons, in which connection there is located a protruding peg on the inner side of each ribbon, and in that each ribbon is arranged for surrounding an ankle. Hereby it is possible for the person to keep the strain for a longer time in e.g. a standing, sitting or sleeping position or condition. The former embodiment is not suitable for this.

According to the invention the tightening ribbons can be made from an elastic material. Hereby can be achieved a uniform pressure strain. There is, however, no hindrance, that the tightening ribbons can consist of lengths with a terminable end and with a closing device permitting a variation of the circumference in the closed condition.

Figure 3:
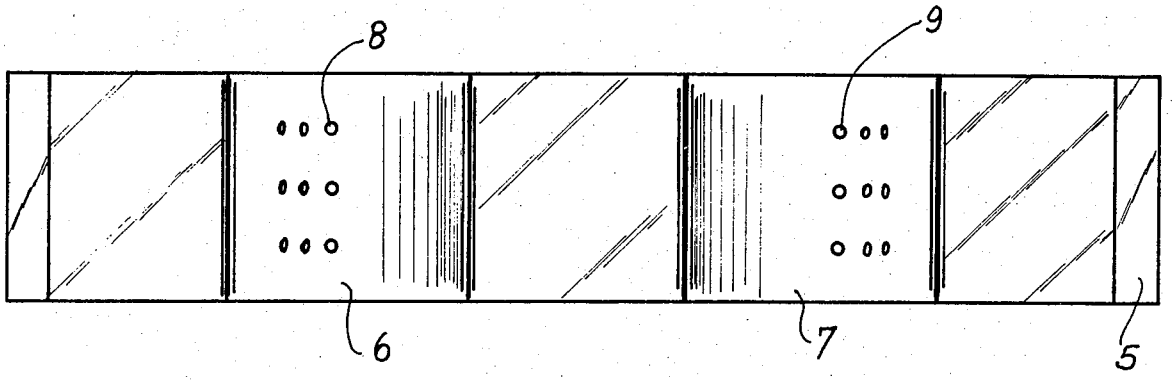
Figure 4:
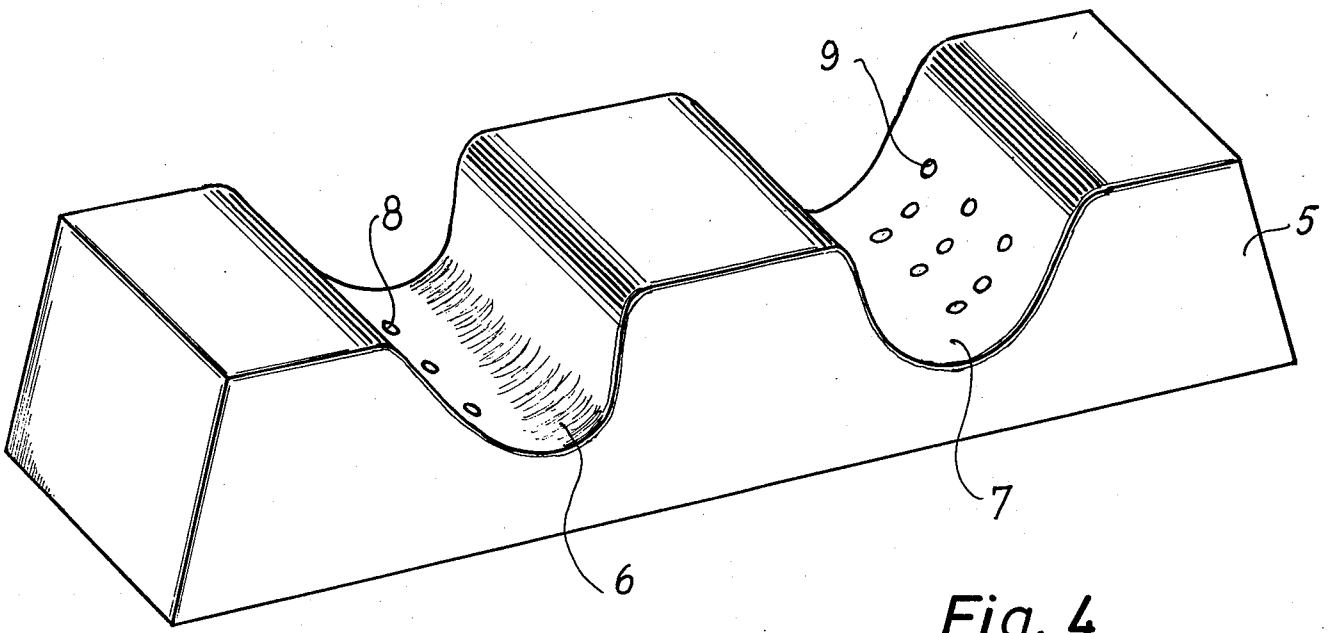

The invention will be further explained below with reference to the drawing, in which FIG. 1 shows a foot and a pair of hands in perspective view, whereby the middle finger of the right hand is pressed against a point situated below the Achilles' tendon, FIG. 2 a trestle or foot stool as a first embodiment of an apparatus according to the invention, provided with two protruding pegs, in front view, FIG. 3 the same trestle in top view without said pegs, FIG. 4 the trestle in perspective view and likewise without pegs and FIG. 5 another embodiment of an apparatus according to the invention, consisting of two tightening ribbons, in perspective view.

FIG. 1 shows a foot 1 and a pair of hands 2 and 3. The foot is kept in a bent position by the hand 2, so that one can by the other hand 3 press a finger 4 against the point situated below the Achilles' tendon at the place where same is in connection with the heel, as shown in FIG. 1. This point is the so-called vesicular point no. 60. It is supposed that by exerting a pressure at this place simultaneously on the right and the left foot, relatively big crystals, which can have been deposited at the extreme nerve fibres, and which exert a decisive influence on the person's general condition, will be crushed. There are at least clear indications, that the natural health mechanisms of the body are strongly stimulatd by a strain according to the invention, which seems to apply to a great number of diseases. A treatment according to the invention also seems to be without secondary effects. Yet it has been ascertained in a number of cases, that in case of first time treatment, diarrhoe occurs after about 12 hours.

Figure 2:
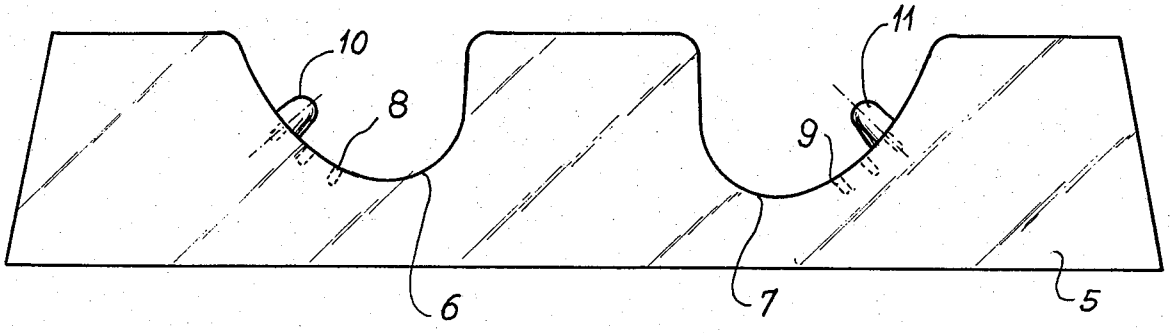

FIG. 2 shows a trestle or foot stool 5 in side elevation, which is provided with two recesses 6 and 7. In these recesses 6 and 7 there is a number of blind holes 8 and 9 in which can be secured pegs 10 and 11, as shown in FIG. 2. FIG. 3 shows the trestle or foot stool 5 in top view, but where the pegs 10 and 11 are not shown. The same applies to FIG. 4 which shows the trestle or foot stool 5 in perspective view. In the three FIGS. 2, 3 and 4 have thus been used the same reference numbers for the same parts. The pegs 10 and 11 can now be placed symmetrically about the middle of the trestle or foot stool in such a manner that they are adjusted to the ankle of the user. The trestle is thus used as a support of the ankles of a horizontally lying person, so that the pegs 10 and 11 are pressed into the area below the Achilles' tendon.

Figure 5:
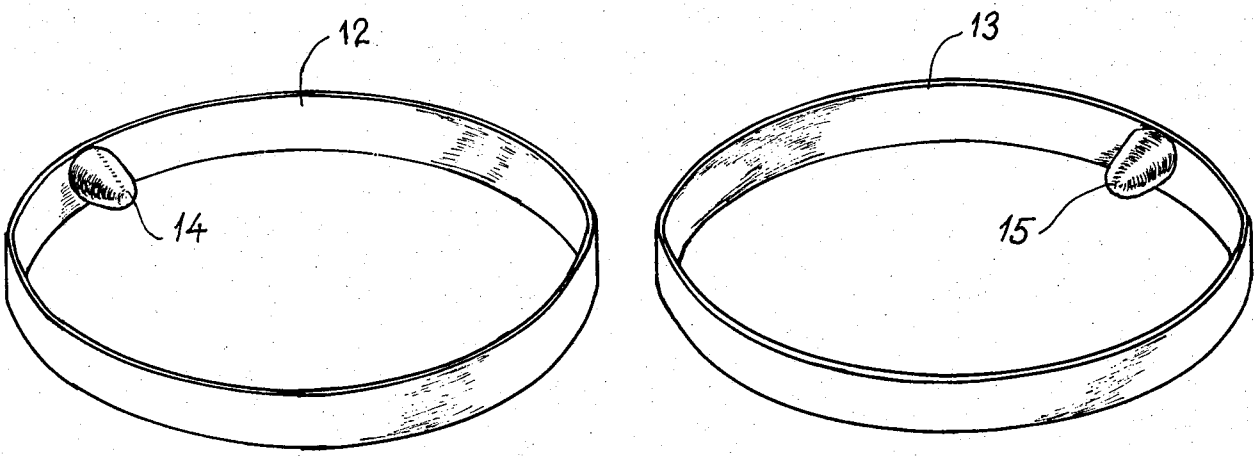

FIG. 5 shows another embodiment consisting of two tightening ribbons 12 and 13 as seen in perspective view. These ribbons consist of closed rings from elastic material. On the inner side of each ribbon 12 and 13 are attached protruding pegs 14 and 15. The tightening ribbons 12 and 13 are intended for fastening about the ankles of the person, who is to be subjected to a treatment, in such a manner, that the pegs are being pressed into the area below the Achilles' tendon. This takes place on account of the ribbons being elastic. There is, however, no hindrance that the ribbons can consist of a not elastic material and be provided with a known closure.

I claim:

1. A method of producing a therapeutic effect in the human body comprising the step of simultaneously applying localized pressure in a relatively small area to the right side of the right foot and the left side of the left foot at a point adjacent the connection of the achilles tendon and the heel at the vesicular point number 60 of each foot.

2. The method of claim 1 wherein equal localized pressures are applied to both the right and the left foot.

3. The method of claim 2 wherein said localized pressure is applied to a person lying on his back in a prone position.

4. An apparatus for providing a therapeutic effect on the human body comprising an elongated foot stool having an upper surface, first and second spaced downwardly extending recesses extending downwardly from said upper surface dimensioned to receive the ankle area of a user, singular protrusion means provided in each of said recesses for providing a localized application of pressure to the vesicular point number 60 of the right side of the right foot and the left side of the left foot of the user when the user places his respective right and left ankle areas in the downwardly extending recesses.

5. The invention of claim 4 wherein said singular protrusion means comprises an outwardly extending peg member provided in each of said recesses.

6. The invention of claim 5 additionally including a plurality of spaced apertures provided in each of said recesses, each of said apertures being capable of receiving and supporting one end of said peg member so as to permit a desired positioning of said peg member in each of said recesses.

7. The invention of claim 6 wherein the outer ends of said peg members are of rounded configuration.

* * * * *